US005327620A

United States Patent [19]

Chen

[11] Patent Number: 5,327,620

[45] Date of Patent: Jul. 12, 1994

[54] FASTENING MEANS FOR CONNECTING A GAITER TO A ROLLER SKATE

[75] Inventor: Ting-Hsing Chen, Tainan, Taiwan

[73] Assignee: Far Great Plastics Industrial Co., Ltd., Tainan, Taiwan

[21] Appl. No.: 157,329

[22] Filed: Nov. 26, 1993

[51] Int. Cl.[5] ..... A43B 11/00

[52] U.S. Cl. ..... 24/68 SK; 24/71 SK; 36/50.1

[58] Field of Search ..... 24/68 SK, 69 SK, 70 SK, 24/71 SK; 36/50.1, 117

[56] References Cited

U.S. PATENT DOCUMENTS

| | | | |
|---|---|---|---|
| 4,624,063 | 11/1986 | Delery | 24/68 SK |
| 4,631,839 | 12/1986 | Bonetti et al. | 24/68 SK |
| 4,761,898 | 8/1988 | Courvoisier et al. | 24/68 SK |
| 4,856,210 | 8/1989 | Delery | 24/68 SK |

*Primary Examiner*—Victor N. Sakran

*Attorney, Agent, or Firm*—Morton J. Rosenberg; David I. Klein

[57] ABSTRACT

A fastening means to secure a gaiter to a roller skate or the like is composed of at least a buckle integral to the back of the skater and a fasten belt on the gaiter adopted to be detachably secured to the buckle in a manner that the position of the fasten belt with respect to the roller skate is adjustable. The fastening means will also proect sportsman from twisted their ankle in exercise.

1 Claim, 8 Drawing Sheets

FASTENING MEANS FOR CONNECTING A GAITER TO A ROLLER SKATE

FIELD OF THE INVENTION

This invention relates to a gaiter connected to a roller skate, and more particularly, to a fastening means to secure the gaiter on the roller skate in a tight and safe manner.

DESCRIPTION OF THE PRIOR ART

The gaiter is generally secured on a roller skate either by rivet joint or by other joint, as shown in FIG. 8. The fastening means is composed of a male part A1 which is adopted to insert through an aperture B1 of a gaiter B and an aperture A3 of the skate and secured at the other end of the aperture A3 with a female part A2. This fastening means is easy to assemble, however, it also tends to disengage when the person who wear the roller skate has an exciting exercise.

SUMMARY OF THE INVENTION

The fastening means for securing a gaiter on a roller skate of the present invention provides an improvement over the prior art fastening means in that it utilizes a buckle integral to the back of the skate and a fasten belt on a gaiter to be secured to the buckle. This end result is achieved without greatly increasing the cost.

In support of the above object, another object of the present invention is to provide a fastening means that will hold the gaiter and the roller skate securely.

It is another object of the present invention to provide a fastening means which is easy to operate.

It is a further object of the present invention to provide a fastening means which is more safe.

DETAILED DESCRIPTION OF THE DRAWINGS

Figure 1:
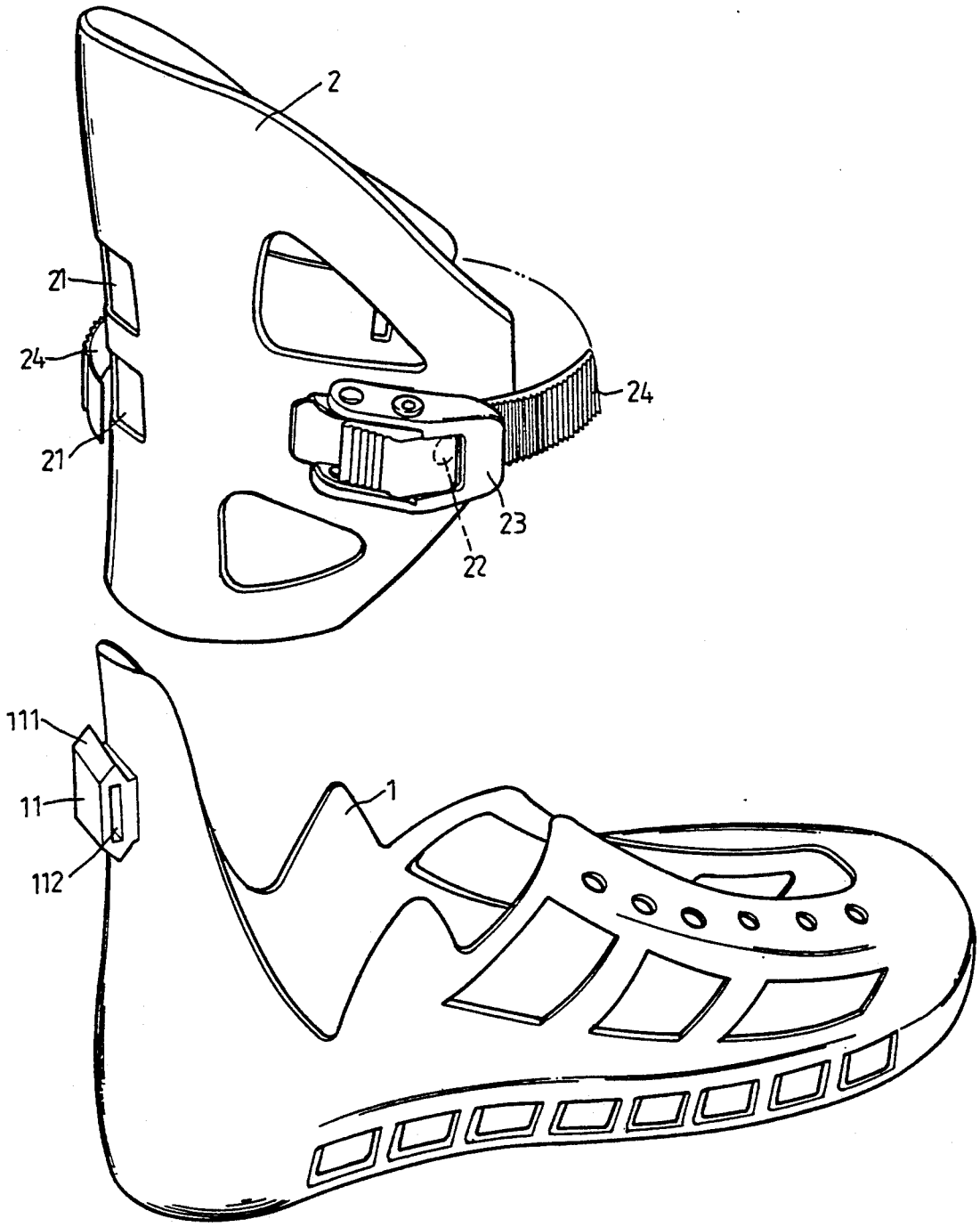
FIG. 1 is a perspetive view of the present invention in which a gaiter having a fasten belt is separated from a roller skate having a buckle integral to its back.

Referring now to the drawings wherein the showings are for the purpose of illustrating preferred embodiments and not for the purpose of limiting the same, FIG. 1, a first embodiment of the invention is illustrated and is composed of a buckle 11 integral to the rear of a roller skate 1, and a gaiter 2 having a fasten belt 24 secured thereto and at least two apertures 21 formed at the rear thereof in vertical position.

The buckle 11 is rectangular in shape having the top and bottom ends protruding a protion, respectively, forming a pair of protuberances 111 thereat, and an hole 112 extending laterally across the buckle through which is passed the fasten belt 24 in a slidable and detachable manner.

The gaiter 2 includes at least two apertures 21 at rear end thereof in align with the buckle 11 of the roller skate 1. The fasten belt 24 has one end secured to a fastener at one side of the gaiter 2 by means of a rivet 22 while the other end of which remains free, which winds from the front portion of the gaiter 2 and wind to the rear end thereof. The belt 24 is slidably and detachably passed through the hole 112 of the roller skate 11 and secured at the fastener 23 again to form a loop thereat.

Figure 2:
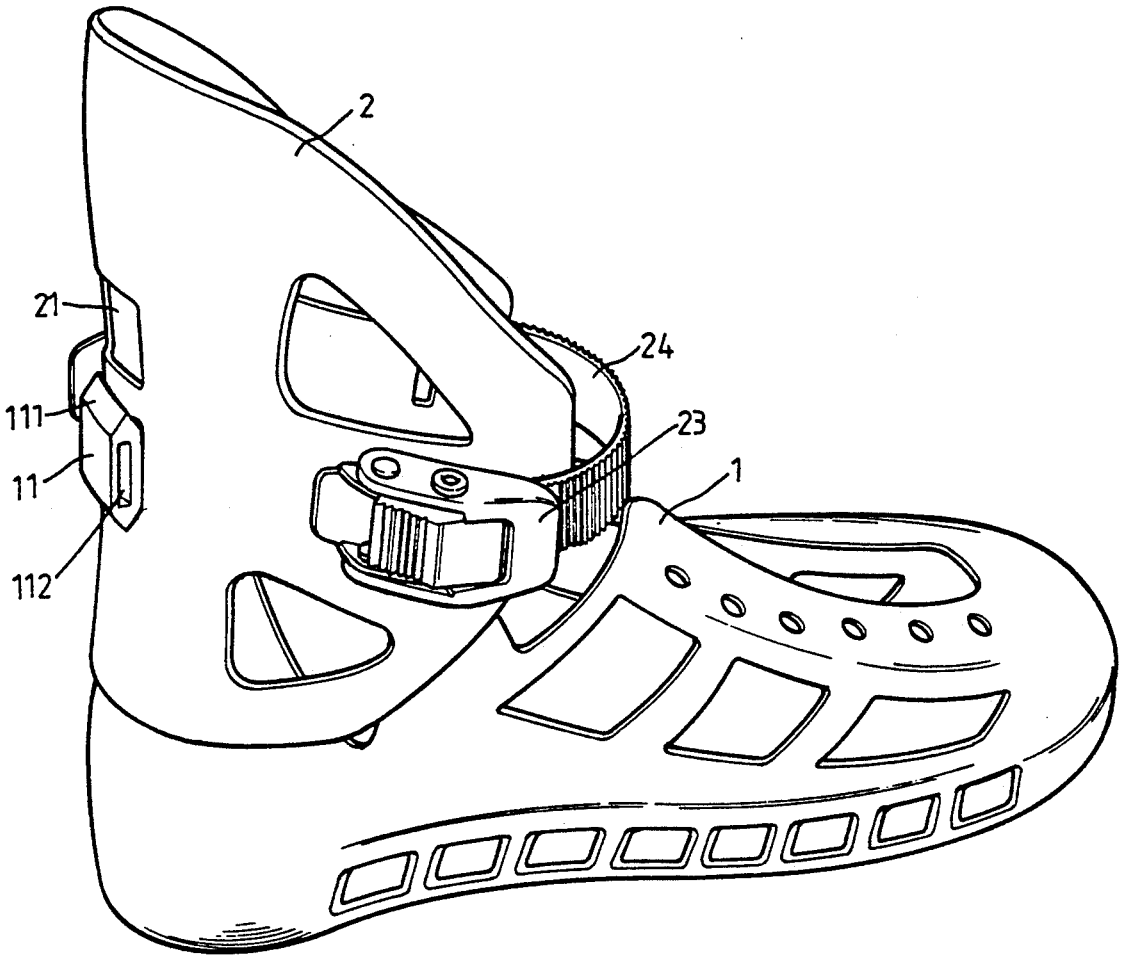
FIG. 2 is a perspective view of FIG. 1 showing the gaiter connected to the roller skate.
Figure 3:
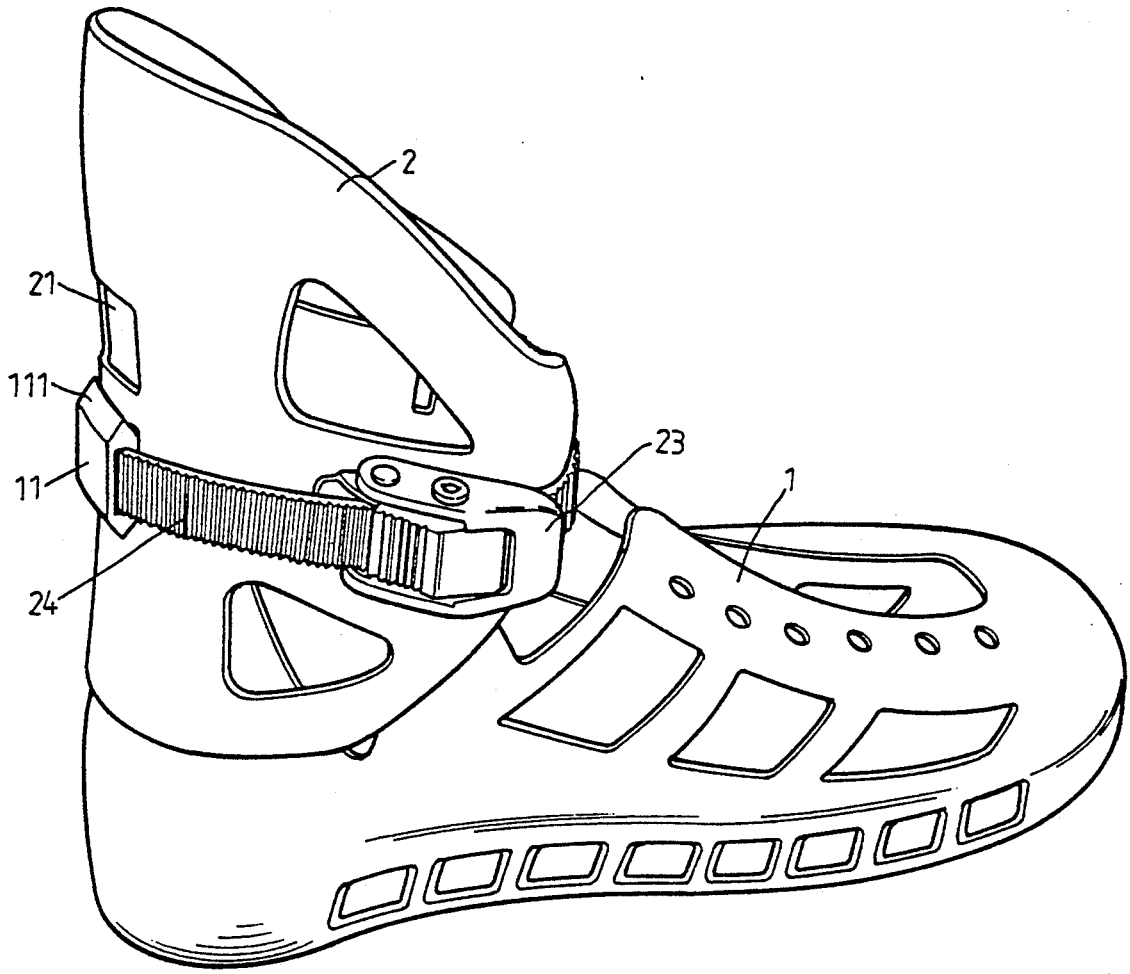
FIG. 3 is a further perspective view of FIG. 2 showing the fasten belt of the gaiter being secured to the buckle of the roller skate.
Figure 4:
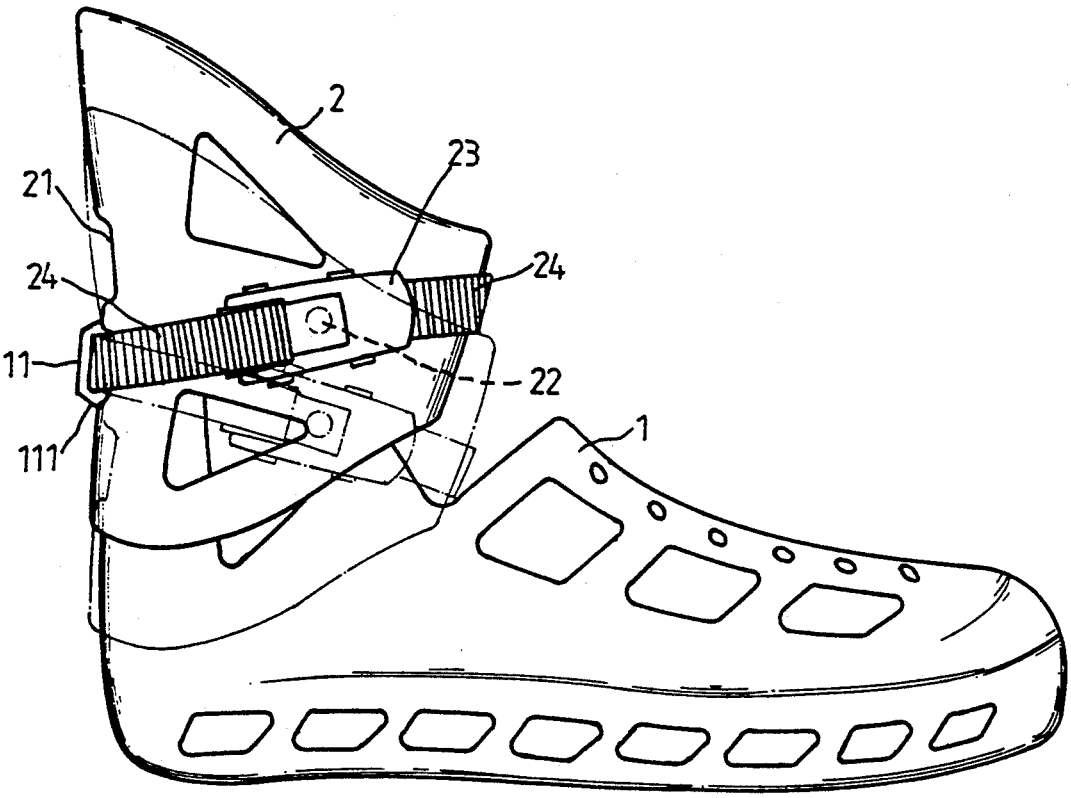
FIG. 4 is a side elevational view showing the gaiter being abe to change its position with respect to the roller sate.

To assemble the present invention, select an aperture 21 of the gaiter 2, decided by the person who who wants to wear the roller skate 1, and press the aperture 21 into the buckle 11 of the roller skate 1, as shown in FIG. 2. The fasten belt 24 then winds from the front to the rear of the gaiter 2 and passes through the hole 112 of the buckle 11 in a slidable and detachable manner. The free end of the belt 24 is then secured at the fastener 23 again, as shown in FIG. 3. Furthermore, since the fastener 23 and the fasten belt 24 are positioned in-between the two apertures 21, the gaiter 2 may be inclined to an degree in order to fasten the free end of the belt 24, as shown in FIG. 4.

Figure 5:
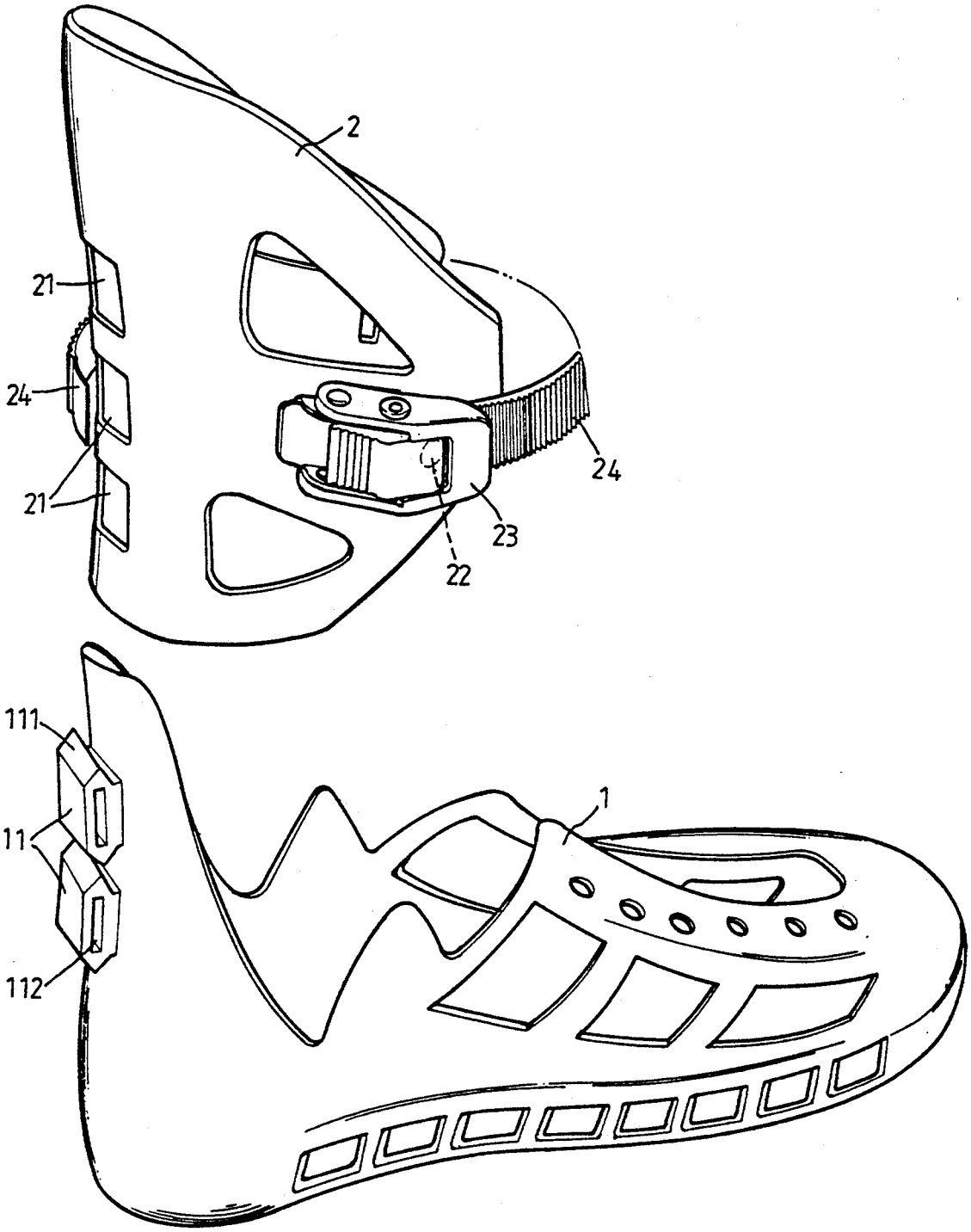
FIG. 5 is a perspective view of a second embodiment of the present invention similar to FIG. 1.
Figure 6:
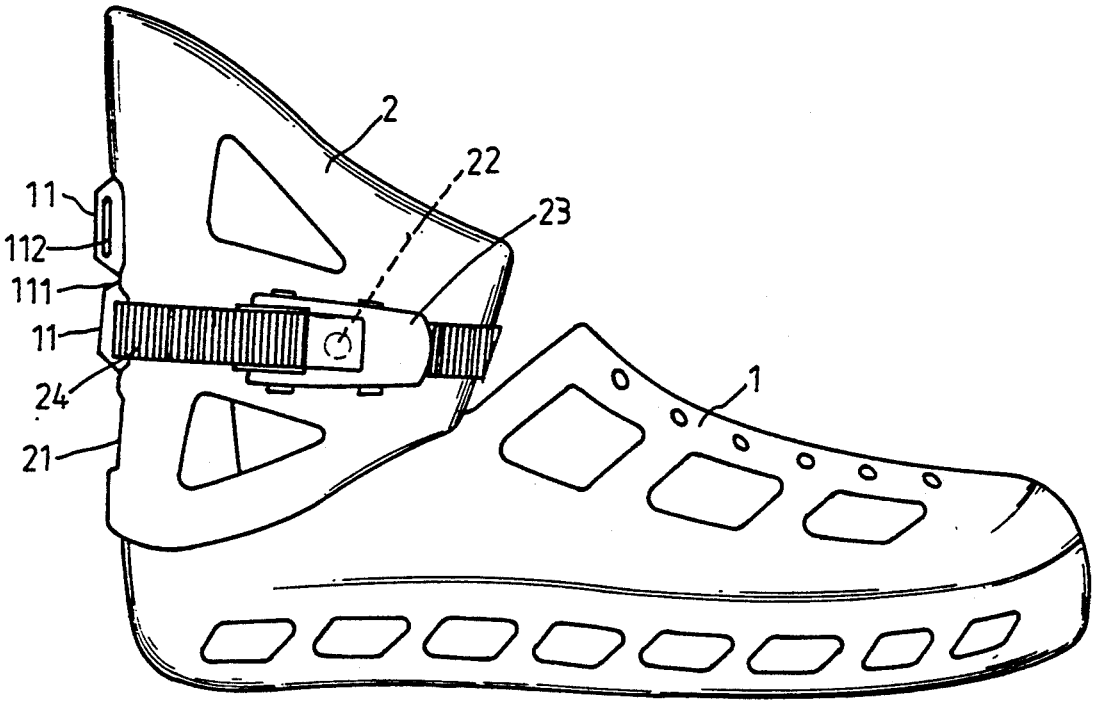
FIG. 6 is a side elevation view of FIG. 5 showing the gaiter being secured to the roller skate at a lower position.
Figure 7:
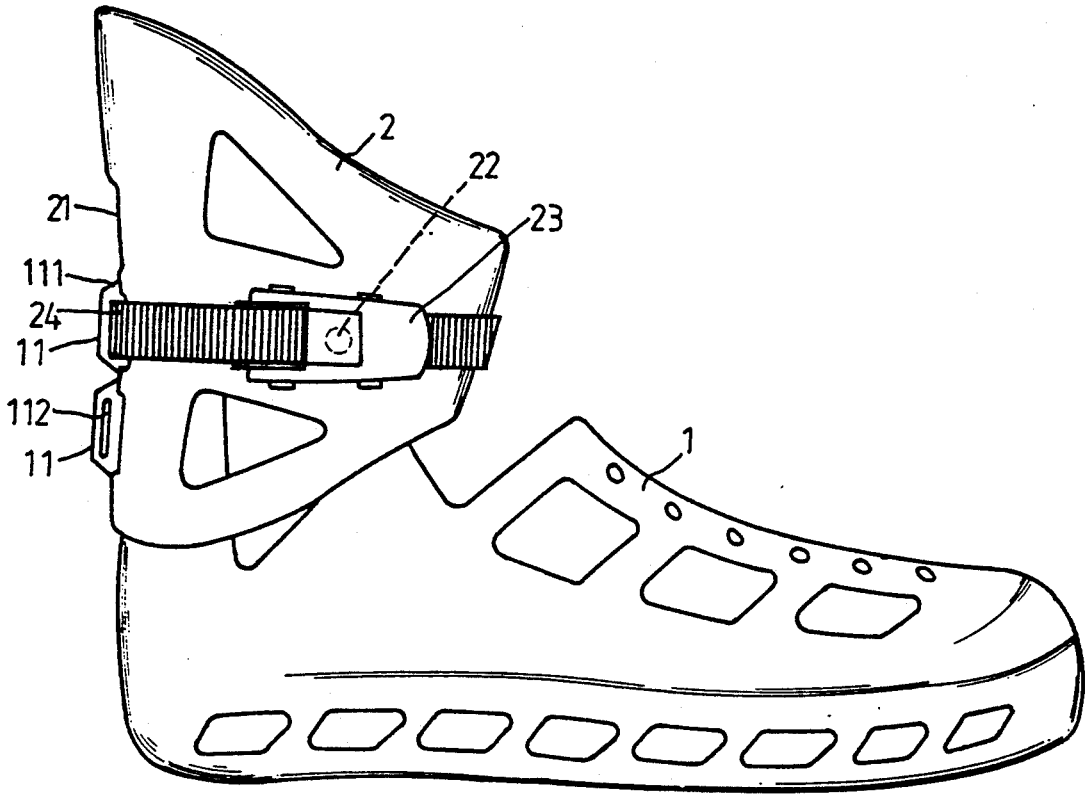
FIG. 7 is another side elevation view of FIG. 5 showing the gaiter being secured to the roller skate at a higher position.
Figure 8:
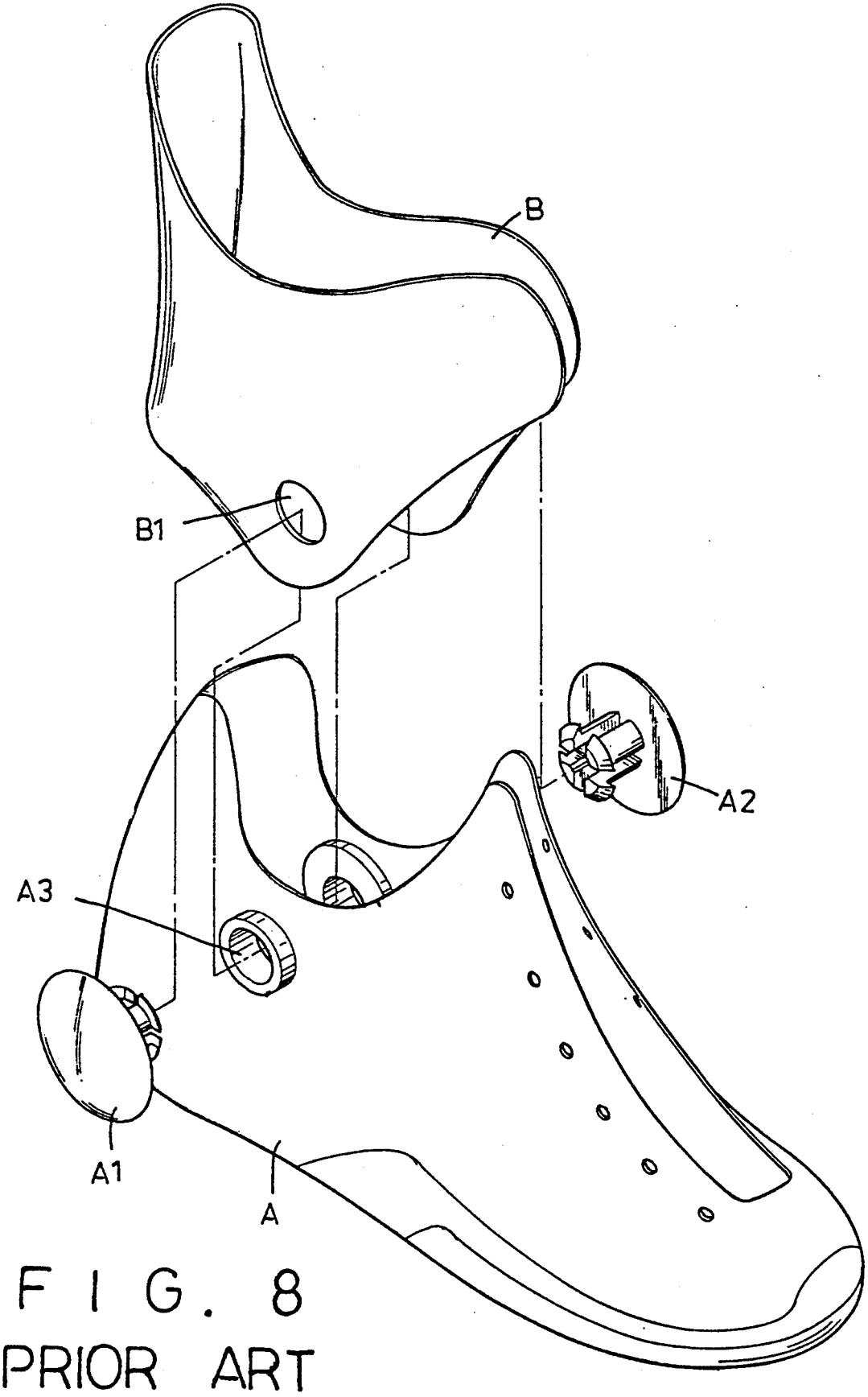
FIG. 8 PRIOR ART
FIG. 8 is a prior art.

FIG. 5 shows a second embodiment of the present invention which shows two buckles 11 are employed at the rear portion of the roller skate 1 and three apertures 21 are employed on the gaiter 2 at the place where two apertures 21 were located. In this embodiment, the fastener 23 is located at center position that aligns with the middle of the three apertures 21.

It is to be noted that since two buckles 11 are formed, no matter which two apertures 21 to be pressed into the buckles, 11, the middle aperture 21 will always engage with one buckle 11 that enables the fasten belt to pass through the hole 112 of the buckle 11 in a horizontal position.

While I have shown my invention in several forms, it will be obvious to those skilled in the art that it is not so limited but is susceptible of various changes and modifications without departing from the spirit thereof.

I claim:

1. A fastening means for connecting a gaiter to a roller skate having a gaiter and a roller skate and the improvements comprising:

said gaiter having at least one aperture at rear portion thereof, a fasten belt having one end secured to a fastener at one side of said gaiter and a free end;

said roller skate having at least one buckle integral to the rear portion of said roller skate, said buckle including a pair of protuberances protruding from the top and the bottom thereof, respectively, adopted to limit movement of said gaiter when said aperture of said gaiter seating thereon, and a hole laterally across the center therein dopted to receive said fasten belt therethrough in a slidable and detachable manner, whereas the position of said gaiter with respect to said roller skate.

* * * * *